US007113197B2

(12) United States Patent
Gao

(10) Patent No.: US 7,113,197 B2
(45) Date of Patent: Sep. 26, 2006

(54) METHOD OF THERMAL PRINTING

(75) Inventor: Zhanjun Gao, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 310 days.

(21) Appl. No.: 10/745,195

(22) Filed: Dec. 23, 2003

(65) Prior Publication Data

US 2005/0134656 A1 Jun. 23, 2005

(51) Int. Cl.
*B41J 2/325* (2006.01)

(52) U.S. Cl. ..... 347/171; 347/217

(58) Field of Classification Search ..... 347/171, 347/217; 428/32.6, 32.63; 400/120.01, 400/237, 241

See application file for complete search history.

(56) References Cited

U.S. PATENT DOCUMENTS 6,303,228 B1 10/2001 Watanabe et al.
6,475,696 B1 11/2002 Majumdar et al.
2003/0211253 A1 11/2003 Torii et al.

FOREIGN PATENT DOCUMENTS

| | | |
|---|---|---|
| EP | 0 383 267 A2 | 6/1995 |
| EP | 0 707 979 A2 | 4/1996 |
| EP | 0 900 659 B1 | 3/1999 |
| EP | 0909659 | 4/1999 |
| JP | 621584 | 1/1987 |
| JP | 6239292 | 2/1987 |
| JP | 632182189 | 7/1988 |
| JP | 1993-024368 | 2/1993 |
| JP | 10-226751 | 8/1998 |

*Primary Examiner*—Huan Tran
(74) *Attorney, Agent, or Firm*—Kathleen Neuner Manne; Lynne M. Blank

(57) ABSTRACT

A method of thermal printing resulting in reduced or no wrinkling of the thermal printing ribbon during printing is described, wherein the ribbon includes inorganic particles in a polymeric host material in at least one layer of the ribbon. The ribbon has improved mechanical and thermal properties as compared to ribbons not incorporating the inorganic particles. The method can be used in high speed printing.

31 Claims, 4 Drawing Sheets

METHOD OF THERMAL PRINTING

CROSS-REFERENCE TO RELATED APPLICATIONS

This application is related to U.S. application Ser. No. 10/744,845 to Gao, entitled "Thermal Printing Ribbon," filed on the same day.

FIELD OF THE INVENTION

A method of thermal printing resulting in reduced wrinkling of the thermal printing ribbon during printing is described.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce individual electrical signals corresponding to certain colors, for example, cyan, magenta, or yellow. These signals can be transmitted to a thermal printer. To obtain a print, a colored dye-donor layer, for example black, cyan, magenta, or yellow, can be placed face-to-face with a dye image-receiving layer of a receiver element to form a print assembly that can be inserted between a thermal print head and a platen roller. The thermal print head can be used to apply heat from the back of the dye-donor. The thermal print head can be heated sequentially in response to the various electrical signals, and the process can be repeated as needed to print all desired colors. A color hard copy corresponding to the original picture can be obtained. A laminate layer can be provided over the color image. Further details of this process and an apparatus for carrying it out are set forth in U.S. Pat. No. 4,621,271 to Brownstein.

At the high temperatures used for thermal dye transfer, for example, about 150° C. to about 200° C., many polymers used in thermal printing ribbons can soften, causing wrinkling of the ribbon, resulting in unwanted lines in the transferred image. A wrinkle can form near the border area of an image. For example, it can spread or extend from a trailing or rear portion of a used dye transfer area at least to a leading or front portion of the next dye transfer area to be used. As a result, a crease or wrinkle can form in the leading or front portion of the next dye transfer area to be used, causing an undesirable line artifact to be printed on a corresponding section of a leading or front portion of the dye receiver when dye transfer occurs at the crease. The line artifact printed on the dye receiver can be relatively short, but quite visible. In fast thermal printing, because of the higher temperature and/or faster movement of the printing ribbon, wrinkling becomes more of a concern.

Various methods of reducing wrinkle formation in the final image are known. For example, mechanical mechanisms that stretch the thermal printing ribbon during printing to prevent crease or wrinkle formation are disclosed in U.S. patent applications Ser. Nos. 10/394,888 and 10/392,502. JP 1999-024368 discloses the use of organic resin fine particles and silicone particles in a dye-donor layer of a thermal printing ribbon to improve the release of a dye from the dye-donor layer to a receiver, reducing sticking of the donor and receiver, and thereby reducing wrinkle formation. However, these methods do not directly address some fundamental factors that can affect wrinkling, i.e., the physical properties of the thermal printing ribbon. U.S. Pat. No. 6,475,696 discloses the use of inorganic particles such as nanoparticles to increase the stiffness of receiver supports for photographic elements, for example, photographic films and papers. The increased stiffness provides desired handling properties for the finished photographic product, but does not reduce the appearance of wrinkles in the image because the wrinkles are generated by the thermal printing ribbon.

JP 1999-208079 and corresponding EP 0909659 disclose a reusable donor for resistive head thermal printing, wherein the donor ribbon substrate includes a low thermally conductive polymer matrix and high thermally conductive metal particles. The particles are oriented such that the long axis of the particles corresponds to the thickness of the substrate. One or more particles can be used to span the thickness of the support. According to the disclosure, the magnetic particles are included to increase the efficiency of heat transfer to the dye-donor element, to increase the thickness and/or strength of the donor support, and to reduce slippage of the support. No effect on wrinkling is described.

A means of eliminating or reducing the formation of creases or wrinkles in a thermal printing ribbon that does not have the problems associated with the prior art is desired. It is further desired that the thermal printing ribbon have desirable bending stiffness, thickness, thermal conductivity, and thermal dimensional stability to help in controlling wrinkle or crease. It is further desired that such a ribbon be capable of high speed printing.

SUMMARY OF THE INVENTION

A method of thermal printing is described, wherein the method includes forming a thermal printing ribbon comprising a dye donor layer, a support, and a polymeric layer, wherein the polymeric layer comprises a polymeric material and at least one inorganic particle; forming a receiver comprising a dye-receiving layer and a support; placing the dye donor layer of the thermal printing ribbon adjacent the dye-receiving layer of the receiver; and printing an image on the receiver, wherein the ribbon remains substantially free of wrinkle during printing.

The method of thermal printing described herein reduces or eliminates wrinkling or crease of the thermal printing ribbon during printing, thereby reducing or eliminating the presence of print artifacts, such as lines, on a corresponding printed image on a dye receiver element. The method can result in use of a thermal printing ribbon that is thinner. The method can be used for high speed printing, and can produce sharper images.

DETAILED DESCRIPTION OF THE INVENTION

Figure 1:
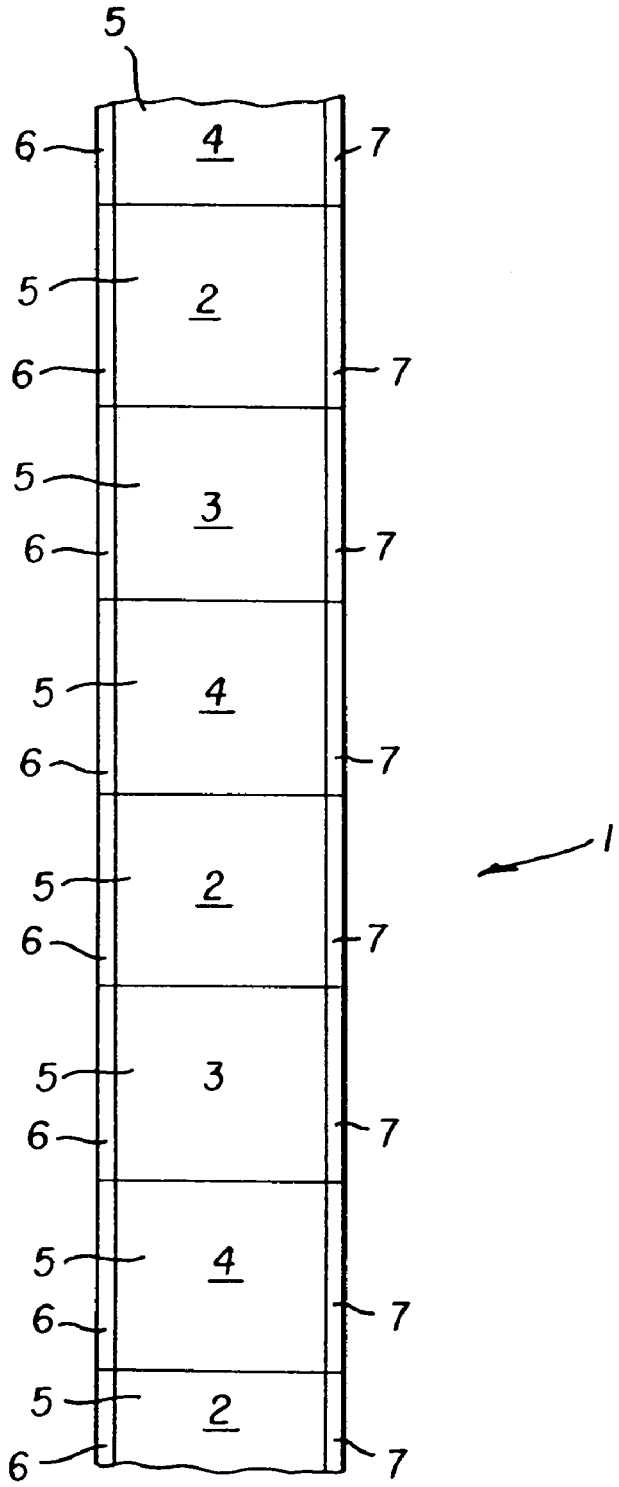
FIG. 1 is a top-down view of a thermal printing ribbon.

A thermal printing ribbon having reduced wrinkle and one or more of increased bending stiffness, reduced thickness, increased thermal conductivity, or increased thermal dimensional stability is described herein, as well as a method of printing with the ribbon. The thermal printing ribbon can include a dye-donor layer and a support. One or more intermediate layer can be present between the dye-donor layer and support, for example, an adhesive layer. One or more sublayer, for example, a slip layer, can be present on the support on a side opposite the dye-donor layer.

The dye-donor layer can include one or more colored areas (patches) containing dyes suitable for thermal printing. As used herein, a "dye" can be one or more dye, pigment, colorant, or a combination thereof, and can optionally be in a binder or carrier as known to practitioners in the art. During thermal printing, at least a portion of one or more colored areas can be transferred to the dye receiver element, forming a colored image on the dye receiver element. The dye-donor layer can include a laminate area (patch) having no dye. The laminate area can follow one or more colored areas. During thermal printing, the entire laminate area can be transferred to the dye receiver element. The dye-donor layer can include one or more same or different colored areas, and one or more laminate areas. For example, the dye-donor layer can include three color patches, for example, yellow, magenta, and cyan, and a clear laminate patch, for forming a three color image with a protective laminate layer on a dye receiver element. Other patch combinations can be used to form various thermal printing ribbons, including monocolor ribbons, laminate ribbons, or various multi-color ribbons with or without laminate patches.

Any dye transferable by heat can be used in the dye-donor layer of the thermal printing ribbon. For example, sublimable dyes can be used such as, but not limited to, anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.); magenta dyes of the structures

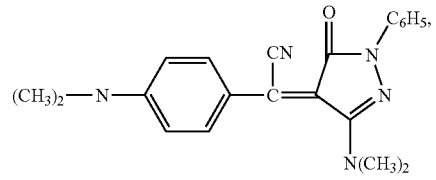

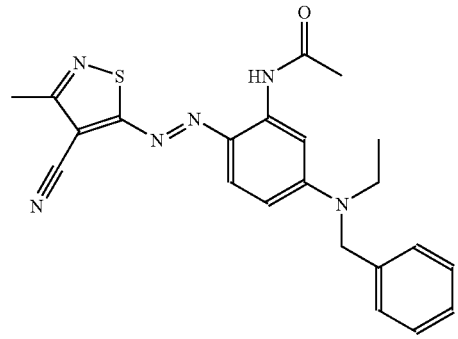

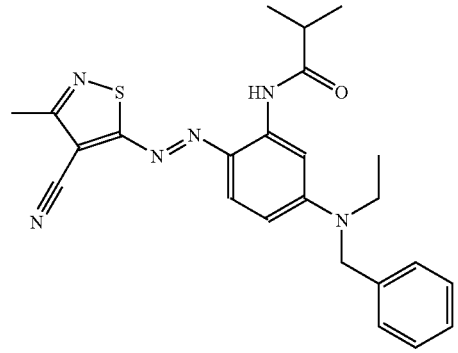

and

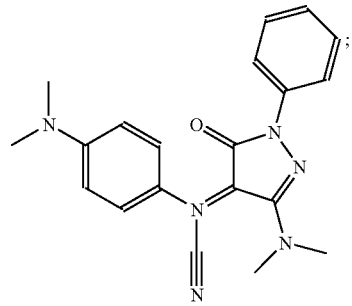

cyan dyes of the structures

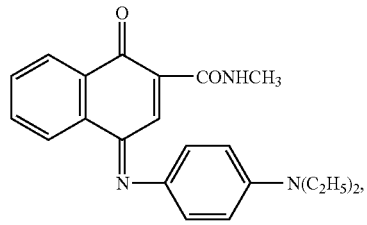

(cyan)

-continued

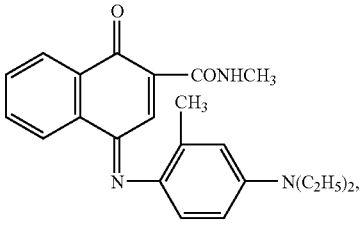

(cyan)

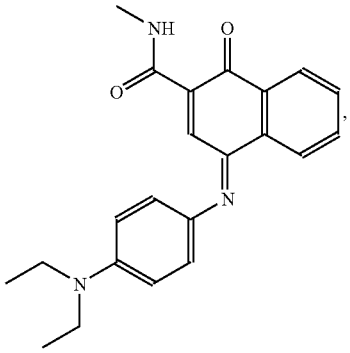

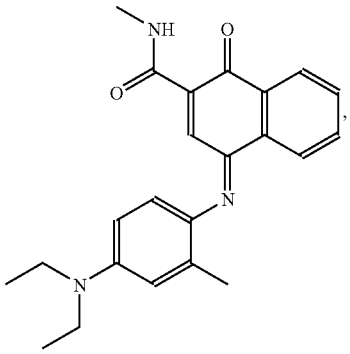

and

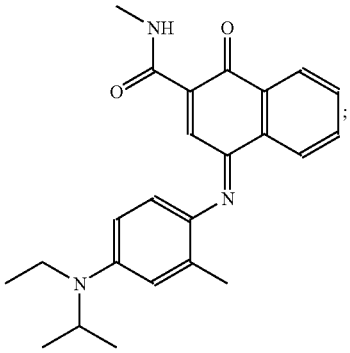

and yellow dyes of the structures

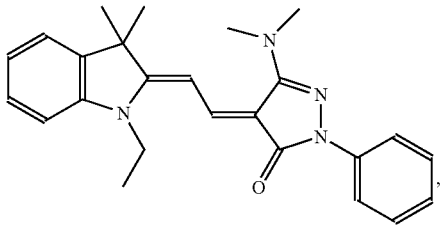

and

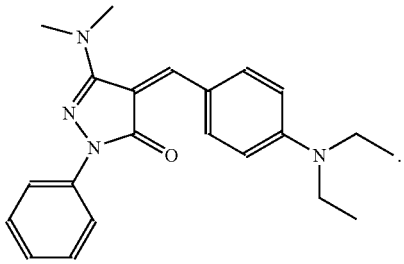

Other examples of dyes are set forth in U.S. Pat. No. 4,541,830, and are known to practitioners in the art. The dyes can be employed singly or in combination to obtain a monochrome dye-donor layer. The dyes can be used in an amount of from about 0.05 g/m$^2$ to about 1 g/m$^2$ of coverage. According to various embodiments, the dyes can be hydrophobic.

The dye-donor layer can have a dye to binder ratio for each color dye patch. For example, a yellow dye to binder ratio can be from about 0.3 to about 1.2, or from about 0.5 to about 1.0. A magenta dye to binder ratio can be from about 0.5 to about 1.5, or from about 0.8 to about 1.2. A cyan dye to binder ratio can be from about 1.0 to about 2.5, or from about 1.5 to about 2.0.

To form a dye-donor layer, one or more dyes can be dispersed in a polymeric binder, for example, a polycarbonate; a poly(styrene-co-acrylonitrile); a poly(sulfone); a poly (phenylene oxide); a cellulose derivative such as but not limited to cellulose acetate hydrogen phthalate, cellulose acetate, cellulose acetate propionate, cellulose acetate butyrate, or cellulose triacetate; or a combination thereof. The binder can be used in an amount of from about 0.05 g/m$^2$ to about 5 g/m$^2$.

The dye-donor layer of the dye-donor element can be formed or coated on a support. The dye-donor layer can be formed on the support by a printing technique such as but not limited to a gravure process, spin-coating, solvent-coating, extrusion coating, or other methods known to practitioners in the art.

The support can be formed of any material capable of withstanding the heat of thermal printing. According to various embodiments, the support can be dimensionally stable during printing. Suitable materials can include polyesters, for example, poly(ethylene terephthalate); polyamides; polycarbonates; glassine paper; condenser paper; cellulose esters, for example, cellulose acetate; fluorine polymers, for example, polyvinylidene fluoride, and poly (tetrafluoroethylene-cohexafluoropropylene); polyethers, for example, polyoxymethylene; polyacetals; and polyolefins, for example, polystyrene, polyethylene, polypropylene, and methylpentane polymers. The support can have a thickness of from about 2 μm to about 30 μm, for example, from about 2 μm to about 10 μm, from about 3 μm to about 8 μm, or from about 4 μm to about 6 μm.

According to various embodiments, a subbing layer, for example, an adhesive or tie layer, a dye-barrier layer, or a combination thereof, can be coated between the support and the dye-donor layer. The adhesive or tie layer can adhere the dye-donor layer to the support. Suitable adhesives are known to practitioners in the art, for example, Tyzor TBT® from E.I. DuPont de Nemours and Company (Del., USA). The dye-barrier layer can include, for example, a hydrophilic polymer. The dye-barrier layer can provide improved dye transfer densities.

The thermal printing ribbon can also include a slip layer capable of preventing the print head from sticking to the thermal printing ribbon. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly(caprolactone), carbowax, polyethylene homopolymer, or poly(ethylene glycol). Suitable polymeric binders for the slip layer can include poly(vinyl alcohol-co-butyral), poly(vinyl alcohol-co-acetal), poly(styrene), poly (vinyl acetate), cellulose acetate butyrate, cellulose acetate, ethyl cellulose, and other binders as known to practitioners in the art. The amount of lubricating material used in the slip layer is dependent, at least in part, upon the type of lubricating material, but can be in the range of from about 0.001 to about 2 $g/m^2$, although less or more lubricating material can be used as needed. If a polymeric binder is used, the lubricating material can be present in a range of from about 0.1 weight % to about 50 weight %, or from about 0.5 weight % to about 40 weight %, of the polymeric binder.

A stick preventative agent as set forth in U.S. patent application Ser. No. 10/667,065, a release agent as known to practitioners in the art, or both, can be added to the thermal printing ribbon. Suitable release agents include those described in U.S. Pat. Nos. 4,740,496 and 5,763,358.

The thermal printing ribbon can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

FIG. 1 depicts a multi-color thermal printing ribbon 1 that can be used in a thermal printer. The ribbon 1 can have a repeating series of colors patches, for example, as shown in FIG. 1, a yellow color patch 2, a magenta color patch 3, and a cyan color patch 4. There can be a transparent laminate patch (not shown) immediately after the cyan color patch 4. Each color patch 2, 3, and 4 can include a dye transfer area 5 that is used for printing. The dye transfer area 5 can extend from one edge of the ribbon 1 to the other, or a pair of opposite longitudinal edge areas 6 and 7 can be alongside the transfer area. Edge areas 6 and 7 are not used for printing. Each pair of edge areas 6 and 7, if present, are colored similar to the dye transfer area 5 bracketed.

Figure 2:
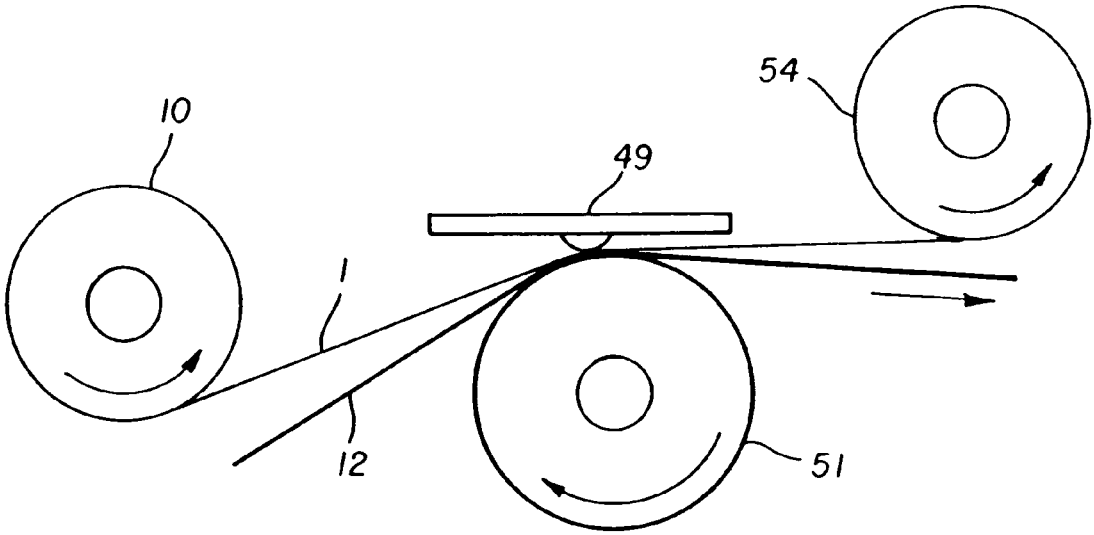
FIG. 2 is a schematic drawing of a printing system.

A thermal printer using the thermal printing ribbon can be operated as shown in FIG. 2 to effect successive image dye transfers, for example, yellow, magenta and cyan dye transfers, in superimposed relation onto a dye receiver element. In operation, the thermal printing ribbon 1 can be moved from a ribbon supply 10 past a print head 49 to a ribbon take-up mechanism, such as reel 54. As each patch of the ribbon 1 is advanced past thermal print head 49, it is brought into alignment with and in close proximity to a receiver 12 over a surface, such as platen roller 51. The print head 49 supplies heat, enabling image-wise transfer of the dye or laminate from the patch on the ribbon 1 to the receiver 12. It is noted that various mechanical arrangements are known in the art for thermal printing. Any such arrangements are suitable for use with the thermal printing ribbon as described herein.

Figure 3:
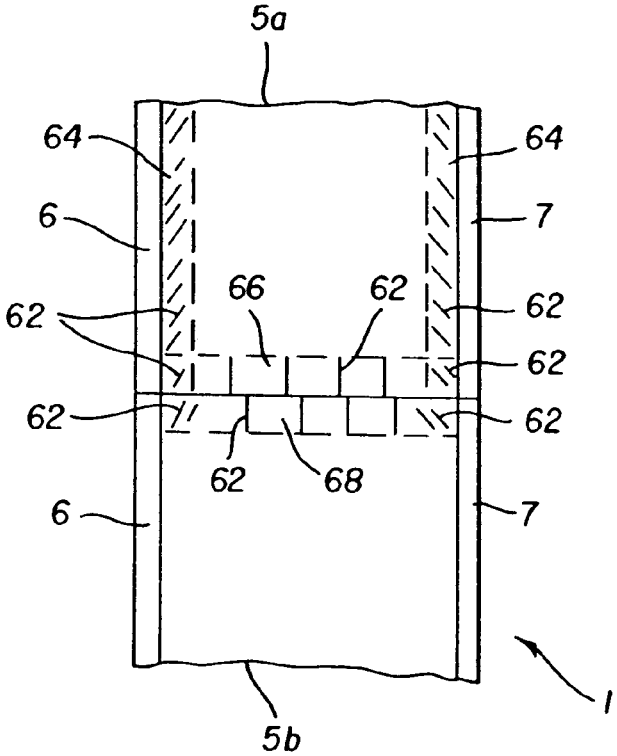
FIG. 3 is a top-down view of a wrinkled thermal printing ribbon.

During printing, the patch of ribbon 1 being printed can be subjected to a longitudinal tension imposed by the pulling force of the ribbon take-up mechanism 54 acting against the ribbon supply 10. The patch being printed can also be heated by the print head 49. Heating the patch of ribbon 1 can weaken the ribbon 1 at the patch by softening due to heating. The softening of the ribbon 1 in a selected area can cause the formation of wrinkles or creases in the transitional areas between the heated ribbon and non-heated ribbon. Wrinkles can also be formed by, or exacerbated by, the longitudinal tension on the ribbon 1. Where a ribbon 1 includes edge areas 6 and 7 around dye transfer area 5, wrinkling can occur at the transition between the dye transfer area 5 and the edge areas 6 and 7 because edge areas 6 and 7 are not necessarily heated by print head 49. For example, as shown in FIG. 3, wrinkles 62 can be formed at a transition area 64 adjacent edge areas 6 and 7 (if present) and/or a rear transition area 66 of a heated dye transfer area 5*a*. The wrinkles at in transition areas 64 and 66 can spread or extend into a front portion 68 of the next dye transfer area 5*b*. The creases or wrinkles 62 can be inclined, as shown in FIG. 3, can form a straight line, or can appear wavy. The resulting crease or wrinkle 62 in the front portion 68 of the next dye transfer area 5*b* can cause an undesirable line artifact to be printed in a corresponding position, that is, the front and/or side edge, of the dye receiver element 12 when image transfer occurs at the crease. The line artifact can be visible as a darker line of dye transfer, or as a failure of the dye to transfer. Creases or wrinkles 62 can be most notable in the regions 64 of the dye transfer area 5 that are adjacent to edge areas 6 and 7, when present, because of the abrupt transition between the weakened dye transfer area 5 and the non-heated edge areas 6 and 7.

With thermal printing techniques, wrinkling of the thermal printing ribbon can occur due to tension and/or heating of the ribbon, as described above. Thermal printing ribbons can be thin, for example, from about 3 μm to about 30 μm, for example, from about 4 μm to about 20 μm, or from about 4 μm to about 8 μm, so any non-uniformity in the ribbon, uneven deformation of the ribbon, or change in local temperature on the ribbon, can produce a local compressive force in a certain direction that can cause the ribbon to buckle, forming creases or wrinkles at the edges of the areas subjected to the compressive force (transition areas). The critical buckling load, Pc, for a rectangular film, for example, a thermal printing ribbon, under a compressive load can be expressed as:

$$P_c = \frac{\pi^2 D}{b^2}\left(\frac{mb}{a} + \frac{a}{bm}\right)^2 \propto D$$

where a and b are the width and length of the film, respectively, m is the number of the sine wave in the buckled state, and D is the called the bending stiffness or bending rigidity, expressed as:

$$D = \frac{Et^3}{12(1 - v^2)}$$

where E is the Young's modulus, t is the thickness of the film, and v is the Poisson's ratio of the film. The above equations demonstrate that for given dimensions of the film (length and width), the critical buckling load is proportional to the bending rigidity of the film, which is a linear function of the Young's modulus and cubic function of the thickness of the film. Thus, changing the Young's modulus, the thickness, or both, of the thermal printing ribbon can affect the critical buckling load of the ribbon. A thicker ribbon, or a ribbon with a higher Young's modulus, or both, can better resist buckling or wrinkling of the ribbon during printing.

Although the above equations would lead one to use a thicker printing ribbon, a thinner printing ribbon is actually desired. A thinner ribbon, achieved by use of thinner layers, can provide a cost advantage by reducing materials used. It can also reduce space requirements of a thermal printer to accommodate the ribbon. The support of the thermal printing ribbon can be the thickest layer in the ribbon, providing stiffness during handling and printing. However, the support can be discarded after printing, making it a waste material. Because it can be discarded after use, the materials and dimension selections of the support can be determined from consideration of a desired stiffness of the resulting thermal printing ribbon.

Increasing the bending stiffness of a thermal printing ribbon by increasing the Young's modulus, E, of one or more of the layers in the ribbon can reduce the occurrence of wrinkle or crease in the thermal printing ribbon during printing. By increasing the Young's modulus, the critical buckling load of the ribbon can be increased by the same percentage. The occurrence of crease or wrinkle can be reduced or eliminated when the critical buckling load of the ribbon is higher than the compressive force on the ribbon. An advantage of increasing the Young's modulus of the thermal printing ribbon is that the ribbon can be made thinner while still reducing or eliminating crease or wrinkle.

The occurrence of crease or wrinkle during printing also can be reduced by increasing the thermal dimensional stability of the thermal printing ribbon. Thermal dimensional stability refers to the ability of the ribbon to maintain its shape and dimension without significant distortion when subjected to increased temperatures. A material is thermally dimensionally stable when it remains substantially free of distortion, curl, or deformation when subjected to increased temperatures, for example, above the glass transition point but below the melting point of the material, as occurs during thermal printing. "Substantially free" means the distortion, curl, or deformation occurs in less than about 15%, for example, less than about 10%, less than about 5%, less than about 2%, or in no portion of the material. A polymeric material can experience shrinkage when exposed to a temperature beyond the glass transition point of the material, causing the material to change shape and dimensions. During the manufacturing process for film materials, internal stresses are induced in the material and effectively remain as residual stresses in the material until it is heated, causing the material to shrink in one or more directions. The residual stress patterns and the amount of shrinkage can be indicative of the direction in which the film has been stretched, the properties of the material, and/or the processing conditions. When a thin polymeric film is under tension, a drop in Young's modulus of the film caused by the increase in temperature can occur, causing deformation of the film, which can be exhibited through crease or wrinkle of the film. Increasing the thermal dimensional stability of the thermal printing ribbon can reduce or eliminate crease or wrinkle during printing.

Increasing the thermal conductivity of a thermal printing ribbon also can reduce or eliminate the occurrence of a crease or wrinkle during printing. Increasing the thermal conductivity of the ribbon allows more heat to transfer through the thickness of the ribbon in less time, enabling the use of less heat, less time, or both, to print an image. Reducing the amount of heat or time of heating also reduces thermally induced deformation in the ribbon, reducing or eliminating wrinkling during printing. According to various embodiments, increased thermal conductivity can also result in sharper images because the heated area has cleaner edges, with more heat being directed down through the ribbon than being spread across the ribbon.

A thermal printing ribbon that has high resistance to wrinkle formation can enable high speed printing because wrinkling of the thermal printing ribbon can be a limiting factor for high speed printing. "High speed" printing as used herein refers to a print speed of about 4 ms/line or less, 2 ms/line or less, or 1.5 ms/line or less.

To achieve a desired Young's modulus, thermal dimensional stability, and/or thermal conductivity, one or more layer of the thermal printing ribbon can include a polymeric material and inorganic particles such as, for example, silica, glass beads, ceramic particles, polymeric particles, metallic particles (for example, Au, Ag, Cu, Pd, Pt, Ni), alumina, mica, graphite, carbon black, or a combination thereof. Inorganic particles can have a higher Young's modulus, thermal dimensional stability, and/or thermal conductivity than polymers. Introducing such inorganic particles into a polymeric layer of a thermal printing ribbon can increase the Young's modulus, thermal dimensional stability, and/or thermal conductivity of the layer. Polymeric materials suitable for use in a thermal printing ribbon can have a Young's modulus of 6 GPa or less, while inorganic particles can have a Young's modulus greater than 6 GPa, for example, greater than or equal to 45 GPa. Polymeric materials suitable for use in a thermal printing ribbon can have a thermal conductivity of about 0.3 W/mK or less, while the thermal conductivity of inorganic particles can be greater than 0.3 W/mK, for example, greater than or equal to 2 W/mK, greater than or equal to 50 W/mK, or greater than or equal to 200 W/mK. To increase the Young's modulus or the thermal conductivity of a thermal printing ribbon, inorganic particles can be added to a polymeric layer of the thermal printing ribbon, wherein the inorganic particles have a higher Young's modulus or a higher thermal conductivity, respectively, than the polymeric material of the layer.

According to various embodiments, the polymeric material including the inorganic particles can be in any layer below the dye-donor layer of the thermal printing ribbon.

For example, the polymeric material including the inorganic particles can be in a layer between the dye-donor layer and the support, the support, a layer beneath the support, or a combination thereof. The polymeric material including the inorganic particles can form an independent layer, or can be co-extruded, laminated, or otherwise combined with one or more other polymers to form a layer of the thermal printing ribbon. The layer including the polymeric material with inorganic particles can be oriented by stretching in a single direction, or two directions, biaxially, either sequentially or simultaneously. According to various embodiments, the polymer including the inorganic materials can form the support of the thermal printing ribbon, or a layer adjacent the support.

The polymeric material can be a polymer such as, for example, a thermoplastic polymer, a water soluble polymer, a thermoplastic elastomer, or a mixture thereof. For example, the polymeric material can be a cellulose ester such as cellulose nitrate or cellulose acetate; poly(vinyl acetate); a polyester such as poly(ethylene terephthalate) or poly(ethylene naphthalate); a polycarbonate; a polyamide; a polyether; a polyolefin; or a combination thereof. The polymeric material can form a voided or non-voided layer.

Suitable polymeric materials can include thermoplastic resins, for example, polylactones such as poly(pivalolactone), poly(caprolactone), and the like; polyurethanes derived from reaction of diisocyanates such as 1,5-naphthalene diisocyanate, p-phenylene diisocyanate, m-phenylene diisocyanate, 2,4-toluene diisocyanate, 4,4'-diphenylmethane diisocyanate, 3,3'-dimethyl-4,4'-diphenyl-methane diisocyanate, 3,3-'dimethyl-4,4'-biphenyl diisocyanate, 4,4'-diphenylisopropylidene diisocyanate, 3,3'-dimethyl-4,4'-diphenyl diisocyanate, 3,3'-dimethyl-4,4'-diphenylmethane diisocyanate, 3,3'-dimethoxy-4,4'-biphenyl diisocyanate, dianisidine diisocyanate, tolidine diisocyanate, hexamethylene diisocyanate, 4,4'-diisocyanatodiphenylmethane and the like, and linear long-chain diols such as poly(tetramethylene adipate), poly(ethylene adipate), poly(1,4-butylene adipate), poly(ethylene succinate), poly(2,3-butylenesuccinate), polyether diols and the like; polycarbonates such as poly(methane bis(4-phenyl)carbonate), poly(1,1-ether bis(4-phenyl) carbonate), poly(diphenylmethane bis(4-phenyl)carbonate), poly(1,1-cyclohexane bis(4-phenyl)carbonate), poly(2,2-bis-(4-hydroxyphenyl) propane) carbonate, and the like; polysulfones, polyether ether ketones; polyamides such as poly(4-amino butyric acid), poly(hexamethylene adipamide), poly(6-aminohexanoic acid), poly(m-xylylene adipamide), poly(p-xylyene sebacamide), poly(2,2,2-trimethyl hexamethylene terephthalamide), poly(metaphenylene isophthalamide) sold as Nomex® by E.I. Dupont de Nemours (Dupont), poly(p-phenylene terephthalamide) sold as Kevlar® by Dupont, and the like; polyesters such as poly (ethylene azelate), poly(ethylene-1,5-naphthalate), poly(ethylene-2,6-naphthalate), poly(1,4-cyclohexane dimethylene terephthalate), poly(ethylene oxybenzoate) sold as A-Tell®, poly(para-hydroxy benzoate) sold as Ekonol® by Eastman Chemical Company (Kingsport, Tenn., USA), poly(1,4-cyclohexylidene dimethylene terephthalate) sold as Kodel® (cis) by Eastman Chemical Company, poly(1,4-cyclohexylidene dimethylene terephthalate) sold as Kodel® (trans) by Eastman Chemical Company, polyethylene terephthlate, polybutylene terephthalate and the like; poly(arylene oxides) such as poly(2,6-dimethyl-1,4-phenylene oxide), poly(2,6-diphenyl-1,4-phenylene oxide) and the like poly (arylene sulfides) such as poly(phenylene sulfide) and the like; polyetherimides; vinyl polymers and their copolymers such as polyvinyl acetate, polyvinyl alcohol, polyvinyl chloride, polyvinyl butyral, polyvinylidene chloride, ethylene-vinyl acetate copolymers, and the like; polyacrylics, polyacrylate and their copolymers such as polyethyl acrylate, poly(n-butyl acrylate), polymethylmethacrylate, polyethyl methacrylate, poly(n-butyl methacrylate), poly(n-propyl methacrylate), polyacrylamide, polyacrylonitrile, polyacrylic acid, ethylene-acrylic acid copolymers, ethylene-vinyl alcohol copolymers acrylonitrile copolymers, methyl methacrylate-styrene copolymers, ethylene-ethyl acrylate copolymers, methacrylated budadiene-styrene copolymers and the like; polyolefins such as poly(ethylene) ((linear) low and high density), poly(propylene), chlorinated low density poly(ethylene), poly(4-methyl-1-pentene), poly(ethylene), poly(styrene), and the like; ionomers; poly(epichlorohydrins); poly(urethane) such as the polymerization product of diols such as glycerin, trimethylol-propane, 1,2,6-hexanetriol, sorbitol, pentaerythritol, polyether polyols, polyester polyols and the like with a polyisocyanate such as 2,4-tolylene diisocyanate, 2,6-tolylene diisocyante, 4,4'-diphenylmethane diisocyanate, 1,6-hexamethylene diisocyanate, 4,4'-dicycohexylmethane diisocyanate and the like; and polysulfones such as the reaction product of the sodium salt of 2,2-bis(4-hydroxyphenyl) propane and 4,4'-dichlorodiphenyl sulfone; furan resins such as poly(furan); cellulose ester plastics such as cellulose acetate, cellulose acetate butyrate, cellulose propionate and the like; silicones such as poly(dimethyl siloxane), poly(dimethyl siloxane), poly(dimethyl siloxane co-phenylmethyl siloxane), and the like; protein plastics; polyethers; polyimides; polyvinylidene halides; polycarbonates; polyphenylenesulfides; polytetrafluoroethylene; polyacetals; polysulfonates; polyester ionomers; polyolefin ionomers; and copolymers and/or mixtures of the aforementioned polymers. According to various embodiments, the thermoplastic resin can be a polyester or a polymer formed from an alpha-beta unsaturated monomer or copolymer.

Useful thermoplastic elastomers can include, for example, brominated butyl rubber; chlorinated butyl rubber; polyurethane elastomers; fluoroelastomers; polyester elastomers; butadiene/acrylonitrile elastomers; silicone elastomers; poly (butadiene); poly(isobutylene); ethylene-propylene copolymers; ethylene-propylene-diene terpolymers; sulfonated ethylene-propylene-diene terpolymers; poly(chloroprene); poly(2,3-dimethylbutadiene); poly(butadiene-pentadiene); chlorosulphonated poly(ethylenes); poly(sulfide) elastomers; block copolymers of glassy or crystalline blocks, for example, poly(styrene), poly(vinyl-toluene), poly(t-butyl styrene), or polyester; and elastomeric blocks, for example, poly(butadiene), poly(isoprene), ethylene-propylene copolymers, ethylene-butylene copolymers, and polyether ester. An example of a suitable block copolymer is the poly(styrene)-poly(butadiene)-poly(styrene) block copolymer manufactured by Shell Chemical Company under the trade name of Kraton®. Copolymers and/or mixtures of the aforementioned polymers can also be used.

Additional suitable polymers can include linear polyesters. The particular polyester chosen for use in any particular formulation can depend on the desired physical properties and features of the polymer containing the inorganic particle. For example, properties for consideration can include tensile strength, Young's modulus, and/or thermal dimensional stability. The polyester can be a homo-polyester or a co-polyester, or mixtures thereof. Polyesters can be prepared by the condensation of an organic dicarboxylic acid and an organic diol. Illustrative examples of useful polyesters will be described herein below in terms of diol and dicarboxylic acid precursors.

Suitable polyesters can include those derived from the condensation of aromatic, cycloaliphatic, or aliphatic diols with aliphatic, aromatic, or cycloaliphatic dicarboxylic acids, and can be cycloaliphatic, aliphatic, or aromatic polyesters. Exemplary cycloaliphatic, aliphatic, and aromatic polyesters can include poly(ethylene terephthalate), poly(cyclohexlenedimethylene), poly(ethylene dodecate), poly(butylene terephthalate), poly(ethylene naphthalate), poly(ethylene(2,7-naphthalate)), poly(methaphenylene isophthalate), poly(glycolic acid), poly(ethylene succinate), poly(ethylene adipate), poly(ethylene sebacate), poly(decamethylene azelate), poly(ethylene sebacate), poly(decamethylene adipate), poly(decamethylene sebacate), poly(dimethylpropiolactone), poly(para-hydroxybenzoate) sold as Ekonol® by Eastman Chemical Company, poly(ethylene oxybenzoate) sold as A-tell®, poly(ethylene isophthalate), poly(tetramethylene terephthalate, poly(hexamethylene terephthalate), poly(decamethylene terephthalate), poly(1,4-cyclohexane dimethylene terephthalate) (trans), poly(ethylene 1, 5-naphthalate), poly(ethylene 2,6-naphthalate), poly (1,4-cyclohexylene dimethylene terephthalate) sold as Kodel® (cis) by Eastman Chemical Company, and poly(1, 4-cyclohexylene dimethylene terephthalate sold as Kodel® (trans) by Eastman Chemical Company.

Suitable polyester compounds can be prepared from the condensation of a diol and an aromatic dicarboxylic acid. Exemplary aromatic carboxylic acids can include, for example, terephthalic acid, isophthalic acid, an a-phthalic acid, 1,3-napthalenedicarboxylic acid, 1,4 napthalenedicarboxylic acid, 2,6-napthalenedicarboxylic acid, 2,7-napthalenedicarboxylic acid, 4,4'-diphenyldicarboxylic acid, 4,4'-diphenysulfphone-dicarboxylic acid, 1,1,3-trimethyl-5-carboxy-3-(p-carboxyphenyl)-idane, diphenyl ether, 4,4'-dicarboxylic acid, and bis-p(carboxy-phenyl) methane. According to various embodiments, aromatic carboxylic acids based on a benzene ring, for example, terephthalic acid, isophthalic acid, and orthophthalic acid, can be used. According to various embodiments, the aromatic carboxylic acid can be terephthalic acid.

According to various embodiments, suitable polyesters can include poly(ethylene terephthalate), poly(butylene terephthalate), poly(1,4-cyclohexylene dimethylene terephthalate), poly(ethylene naphthalate), and copolymers and/or mixtures thereof. According to various embodiments, the polyester can be poly(ethylene terephthalate).

Other suitable thermoplastic polymers for use in forming the nanocomposite can be formed by polymerization of alpha-beta-unsaturated monomers of the formula $R^1R^2C{=}CH_2$, wherein $R^1$ and $R^2$ are the same or different and are cyano, phenyl, carboxy, alkylester, halo, alkyl, alkyl substituted with one or more chloro or fluoro, or hydrogen. Examples of such polymers can include ethylene, propylene, hexene, butene, octene, vinylalcohol, acrylonitrile, vinylidene halide, salts of acrylic acid, salts of methacrylic acid, tetrafluoroethylene, chlorotrifluoroethylene, vinyl chloride, styrene, and copolymers and/or mixtures thereof.

According to various embodiments wherein the polymeric material includes a thermoplastic polymer formed by polymerization of alpha-beta-unsaturated monomers, the thermoplastic polymer can be poly(propylene), poly(ethylene), poly(styrene), or copolymers and/or mixtures thereof. According to various embodiments, the thermoplastic polymer can be a poly(propylene) polymer or copolymer.

Suitable hydrophilic polymers for use in the polymeric material can include polymers set forth in U.S. Pat. Nos. 5,683,862; 5,891,611; and 6,060,230. The water soluble polymers can comprise polyalkylene oxides such as polyethylene oxide, poly 6,(2-ethyloxazolines), poly(ethyleneimine), poly(vinyl pyrrolidone), poly(vinyl alcohol), poly (vinyl acetate), poly(styrene sulfonate), poly(acrylamide), poly(methacrylamide), poly(N,N-dimethacrylamide), poly (N-isopropylacrylamide), polysaccharide, dextran, and cellulose derivatives such as carboxymethyl cellulose, hydroxyethyl cellulose, and others known in the art.

Suitable hydrophilic polymers can include hydrophilic colloids such as gelatin or gelatin-grafted polymers. Any of the known types of gelatin used in imaging elements can be used, for example, alkali-treated gelatin (cattle bone or hide gelatin), acid-treated gelatin (pigskin or bone gelatin), modified gelatins such as those disclosed in U.S. Pat. No. 6,077,655 and references cited therein, gelatin derivatives such as partially phthalated gelatin, acetylated gelatin, deionized gelatin, and gelatin grafted onto vinyl polymers as disclosed in U.S. Pat. Nos. 4,855,219; 5,066,572; 5,248,558; 5,330,885; 5,910,401; 5,948,857; and 5,952,164. Other hydrophilic colloids that can be utilized in the present invention, either alone or in combination with gelatin, include dextran, gum arabic, zein, casein, pectin, collagen derivatives, collodion, agar-agar, arrowroot, and albumin. Other useful hydrophilic colloids can include water-soluble polyvinyl compounds such as polyvinyl alcohol, polyacrylamide, and poly(vinylpyrrolidone).

Inorganic particles can be added to the polymeric material in any amount sufficient to achieve the desired physical properties. If the amount of the inorganic particles added is too low, the desired improvement in properties cannot be achieved. If the amount of the inorganic particles added is too high, the thermal printing ribbon can become brittle or unsuitable for processing under typical processing conditions. Inorganic particles can be included in the polymeric material in an amount of less than or equal to about 50% by weight, for example, from about 2% to about 50% by weight, from about 2% to about 20% by weight, from about 2% to about 12% by weight, or from about 4% to about 8% by weight. The low loading level of the inorganic particles allows the combination of polymeric host material and inorganic particles to be processed in a similar manner as the polymeric host material without inorganic particles. This allows for utilization of the same manufacturing equipment under similar processing conditions. Low loading of the inorganic particles also provides a thermal printing ribbon with improved mechanical and thermal properties without a significant increase in cost. The inorganic particles can be swellable so that other agents, for example, organic ions or molecules, can intercalate and/or exfoliate the inorganic particles, resulting in a desirable dispersion of the inorganic particles in the polymeric material.

The inorganic particles can have a Young's modulus greater than 6 GPa, for example, greater than or equal to 45 GPa. The inorganic particles can have a Young's modulus that is greater than that of the polymeric material, for example, two times, three times, four times, or more than four times the Young's modulus of the polymeric material. The thermal conductivity of the inorganic particles can be greater than 0.3 W/mK, for example, greater than or equal to 2 W/mK, greater than or equal to 50 W/mK, or greater than or equal to 200 W/mK. The inorganic particles can have any shape, for example, irregular, round, rod-like, plate-like, or any other shape. The inorganic particles can have a shortest dimension of about 0.5 nm or greater, and a longest dimension up to about 2000 nm or less. The aspect ratio (ratio of the longest to the shortest dimension) of the inorganic particles can be from about 1:1 to about 4000:1, or from about 1:1 to about 200:1.

Suitable inorganic materials include those having one or more of the properties described above, and can include, for example, silica, glass beads, ceramic particles, polymeric particles, metallic particles (e.g., Au, Ag, Cu, Pd, Pt, Ni), alumina, mica, graphite, carbon black, or a combination thereof. Any inorganic material having a Young's modulus, a thermal dimensional stability, or a thermal conductivity higher than that of the polymeric material can be suitable for use.

According to various embodiments, the inorganic particles can be alumina, having a diameter from about 5 nm to about 100 nm. The Young's modulus of the alumina can be from about 250 GPa to about 400 GPa. Incorporation of alumina particles into the thermal printing ribbon can enhance the Young's modulus of the thermal printing ribbon. The alumina particles can also increase the thermal dimensional stability and thermal conductivity of the printing ribbon.

According to various embodiments, the polymeric material including an inorganic particle can be a nanocomposite material. A nanocomposite is a material made by combining two or more materials by mixing or bonding, wherein at least one material has a greatest diameter in the nanometer range. Because at least one of the materials in the nanocomposite is so small, the nanocomposite behaves like a homogeneous material. Nanocomposites can impart improved mechanical and thermal properties while having a relatively low weight % loading of inorganic particles in the polymeric material, thereby improving one or more physical property of the polymeric material without significantly increasing cost. Recently, nanocomposite materials have received considerable interest from industrial sectors, such as the automotive industry and the packaging industry for their unique physical properties. These properties include improved heat distortion characteristics, barrier properties, and mechanical properties, as described in U.S. Pat. Nos. 4,739,007; 4,810,734; 4,894,411; 5,102,948; 5,164,440; 5,164,460; 5, 248,720; 5,854,326; and 6,034,163. The use of nanocomposites in thermal printing ribbons has not previously been suggested.

Suitable inorganic particles for use in a nanocomposite can include materials which form in layers and which can be intercalated with swelling agents to expand the interlayer spacing, forming separated nanoparticles. Such inorganic layered materials can include phyllosilicates, for example, smectite clays including montmorillonite, sodium montmorillonite, magnesium montmorillonite, and/or calcium montmorillonite, examples of which are set forth in U.S. Pat. Nos. 4,739,007, 4, 810,734, 4,889,885, 4,894,411, 5,102,948, 5,164,440, 5,164,460, 5,248,720, 5,973,053, and 5,578,672; nontronite; beidellite; volkonskoite; hectorite; saponite; sauconite; sobockite; stevensite; svinfordite; vermiculite; halloysite; magadite; kenyaite; talc; mica; kaolinite; and mixtures thereof. Other suitable inorganic layered materials can include illite, mixed layered illite/smectite minerals such as ledikite, and admixtures of illites with the clay materials named above. Other suitable inorganic layered materials, particularly useful with anionic polymers, are layered hydrotalcites or double hydroxides, for example, $Mg_6Al_{3.4}(OH)_{18.8}(CO_3)_{1.7}H_2O$, which have positively charged layers and exchangeable anions in the interlayer spaces. Other layered materials having little or no charge on the layers can be useful provided they can be intercalated with swelling agents to expand their interlayer spacing. Such layered materials can include chlorides such as $FeCl_3$, FeOCl; chalcogenides such as $TiS_2$, $MoS_2$, and $MoS_3$; cyanides such as $Ni(CN)_2$; and oxides such as $H_2Si_2O_5$, $V_6O_{13}$, $HTiNbO_5$, $Cr_{0.5}V_{0.5}S_2$, $V_2O_5$, Ag doped $V_2O_5$, $W_{0.2}V_{2.8}O_7$, $Cr_3O_8$, $MoO_3(OH)_2$, $VOPO_4.2H_2O$, $CaPO_4CH_3.H_2O$, $MnHAsO_4.H_2O$, and $Ag_6Mo_{10}O_{33}$.

According to various embodiments, the inorganic layered material can be a phyllosilicate of a 2:1 type, having a negative charge on the layers and a commensurate number of exchangeable cations in interlayer spaces to maintain overall charge neutrality. For example, phyllosilicates with a cation exchange capacity of 50 to 300 milliequivalents per 100 grams can be used.

Smectite clay suitable for use in the nanocomposite can be natural or synthetic. This distinction can influence the particle size and/or the level of associated impurities. Synthetic clays can be smaller in at least one dimension than corresponding natural clays, providing a smaller aspect ratio. Synthetic clays can be more pure than corresponding natural clays. Synthetic clays can have a narrower size distribution than corresponding natural clays. Synthetic clays may not require purification or separation before use. Suitable clay particles, whether synthetic or natural, can have a length of between about 10 nm and about 5000 nm, for example, between about 50 nm and about 2000 nm, or between about 100 nm and about 1000 nm. If the particle dimension is too small, the inorganic particles may not significantly improve physical properties of the polymer to which they are added. If the particle dimension is too large, optical properties of the polymer to which the particles are added can be affected, for example, transparency. The thickness of the clay particles can vary between about 0.5 nm and about 10 nm, or from about 1 nm to about 5 nm. The aspect ratio can be >10:1, >100:1, or >1000:1. According to various embodiments, the thickness of the clay particles is such that transparency of the polymer containing the particles can be maintained.

The inorganic particles, including those provided as layered materials, can be treated with organic molecules, for example, ammonium ions. The organic molecules can intercalcate between adjacent planar layers and/or exfoliate the individual layers of the inorganic particles or layered material. Intercalcating or exfoliating the layers allows the layers to be admixed with the polymer to improve one or more properties of the polymer, for example, mechanical strength, thermal conductivity, and/or thermal dimensional stability. The layers can be admixed with the polymer before, after, or during the polymerization of the polymer. The admixed inorganic particles and polymer, forming the nanocomposite, can be processed similar to a homogeneous unit of the polymer.

The polymeric material can include additional components besides the inorganic particles. For example, the polymeric material can also include one or more nucleating agent; filler; plasticizer; impact modifier; chain extender; lubricant; antistatic agent; pigment such as titanium oxide, zinc oxide, talc, calcium carbonate, or the like; dispersant such as a fatty amide (e.g., stearamide) or metallic salts of fatty acids (e.g., zinc stearate, magnesium stearate); colorant or dye such as ultramarine blue or cobalt violet; antioxidant; fluorescent whitener; ultraviolet absorber; fire retardant; roughening agent; cross-linking agent; voiding agent, or a combination thereof. The terms "dye," "colorant," and "pigment" as used herein are interchangeable, and are each independently meant to include dyes, colorants, and pigments. The types of optional components mentioned above can be added in appropriate amounts determined by need, as known to practitioners in the art. The inorganic particles can be incorporated into the polymeric material by any suitable means known in the art. For example, the inorganic particles can be dispersed in a suitable monomer or oligomer of the desired polymer. The monomer or oligomer can be polymerized, for example, by methods similar to those disclosed in U.S. Pat. Nos. 4,739,007 and 4,810,734. Alternatively, the inorganic particles can be melt-blended with the polymer, oligomer, or mixture thereof, at temperatures at or above the melting point of the polymer, oligomer, or mixture. The melt-blended composition can be sheared, for example, by methods similar to those disclosed in U.S. Pat. Nos. 5,385,776; 5,514,734; or 5,747,560.

The inorganic particles can be oriented in the polymeric material to improve thermal conductivity. Isotropic (random) orientation of thermally conductive inorganic particles in the polymeric material can increase thermal conductivity of the polymeric material generally, thereby increasing the conductivity of the thermal printing ribbon as a whole. This enables high speed printing and/or printing at lower temperatures while maintaining good image transfer because the increased thermal conductivity enables faster and more efficient transfer of heat from the print head through the thermal printing ribbon to the dye-donor layer. Anisotropic orientation of thermally conductive inorganic particles in the polymeric material similarly increases conductivity of the thermal printing ribbon, enabling high speed printing and/or a reduction in printing temperature while maintaining good image transfer. Anisotropic orientation of the particles along the thickness of the polymeric material, that is, aligning the particles from the top to the bottom of the material, also produces sharper images because more heat is directed in the thickness direction (to transfer the dye) than in lateral direction. The thermal printing ribbon and each layer therein can be formed by any suitable method known in the art, for example, solvent casting, extrusion, co-extrusion, blow molding, injection molding, or lamination. The thermal printing ribbon as a whole, or individual layers thereof, can be oriented by stretching in one or two directions. According to various embodiments, the layer including the polymeric material and inorganic particles can be oriented in at least one direction. According to various embodiments, the layer including the polymeric material. and inorganic particles can be oriented in both directions, or biaxially, either simultaneously or consecutively, by any method known in the art for biaxial orientation of polymeric materials.

Thermal printing ribbons as described herein can have a structure as described in one or more of the following U.S. Pat. Nos. 6,600,505; 6,309,498; 6,303,228; 6,303,210; 6,088,048; 6,063,842; 6,057,385; 6,043,833; 5,977,208; 5,932,643; 5,908,252; 5,853,255; 5,698,490; 5,681,379; 5,552,231; 5,547,298; 5,538,351; 5,342,672; 5,318,368; 5,248,652; 5,240,781; 5,182,252; 5,158,813; 5,157,413; 5,128,308; 5,089,350; 4,995,741; 4,988,563; or 4,983,445, or U.S. Patent Application Publication No. US2002/0033875. The thermal printing ribbon can have a thickness from about 3 μm to about 30 μm, or from about 4 μm to about 20 μm. The thermal printing ribbon can be substantially free of wrinkle or crease during printing, wherein "substantially free" means a reduction in the occurrence of wrinkle during printing over a thermal printing ribbon without inorganic particles of at least 80%, for example, a reduction of 85%, 90%, 95%, or 100%.

Properties desirable in thermal printing ribbons, which can aid in reducing crease or wrinkle during printing, include Young's modulus, thickness, thermal conductivity, and thermal dimensional stability. Thermal printing ribbons with one or more of these properties as described herein reduce or eliminate crease or wrinkle during printing, thus reducing or eliminating the appearance of print artifacts in a corresponding printed image on a dye-receiver element. The thermal printing ribbon as described herein can also enable high speed printing with reduced or no wrinkling during printing, and is thermally dimensionally stable.

EXAMPLES

The following examples illustrate the practice of this invention. They are not intended to be exhaustive of all possible variations of the invention. Parts and percentages are by weight unless otherwise indicated.

Example 1

Young's Modulus

Two different types of nano-clay particles were used in this experiment. Laponite® RDS and Cloisite® $Na^+$ were supplied by Southern Clay Products, Inc (Gonzales, Tex., USA). Laponite RDS is a synthetic hectorite of a fine white powder. Cloisite $Na^+$ is a purified naturally occurring smectic silicate of a greenish yellow powder. Some of their properties are listed in Table 1. The aspect ratio, L/t, is defined as the ratio of the largest dimension to the smallest dimension of the clay particle.

TABLE 1

| Type of clay | Aspect ratio L/t | Surface area $m^2/g$ |
|---|---|---|
| Laponite RDS | 20–30 | 370 |
| Cloisite $Na^+$ | 200 | 750 |

Non-deionized gelatin of type 4, class 30, was used. The density of the gelatin was 1.34 $g/cm^3$. The Young's modulus was 3.19 GPa.

An aqueous mixture of solid clay and gelatin was made in a 50° C. water bath using a high shear device. The mixture was coated on a clean poly(ethylene terephthalate) (PET) support using a coating knife of 40 mil clearance. The coating was chilled, then placed in ambient condition to dry for at least two days. A free-standing film of around 1 mil was peeled off the PET support and stored in a standard 50% RH, 21° C. environment before further testing. Using the above procedure, the following samples were made: Sample 1—pure gelatin; Sample 2—Cloisite-gelatin composite; Sample 3—Laponite-gelatin composite. Various loading ranges of each clay were prepared, as detailed below.

Figure 4:
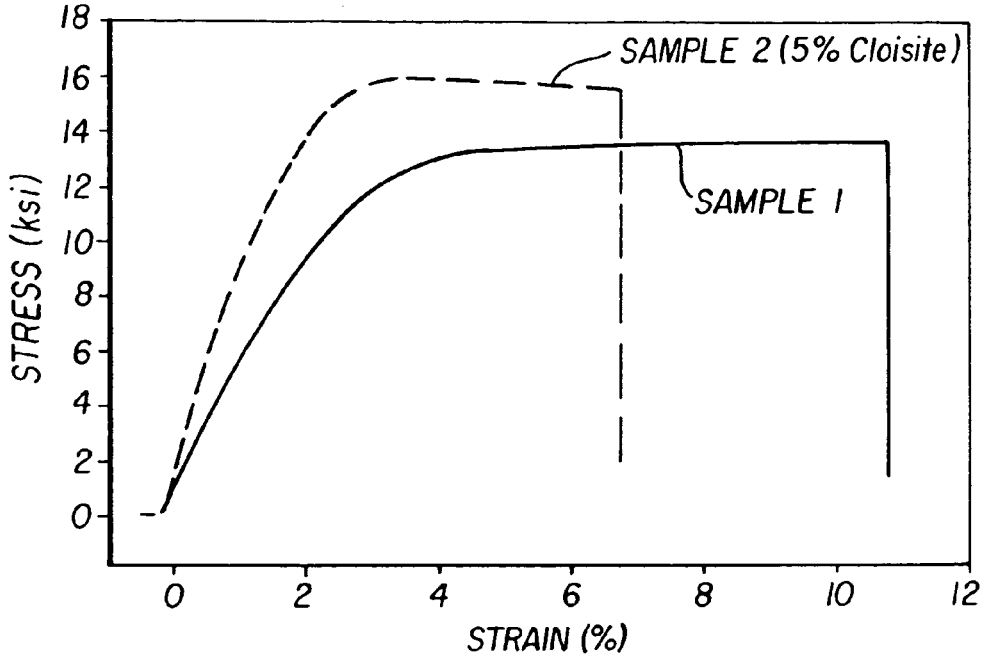
FIG. 4 depicts stress versus strain curves for an embodiment of the invention and gelatin.

Tensile strength tests according to test procedure ASTM D 882-80a in a standard environment of 50% RH and 23° C. were performed on samples of gelatin and a Cloisite-gelatin composite having 5% loading of Cloisite. The tensile test was conducted using a Sintech 2 operated via Testwork version 4.5 software with an Instron frame and load cell. A load cell of 50 lbs and a pair of grips of one flat and one point face were used. The sample size was 6.35 mm wide by 63.5 mm gauge length. The crosshead speed was set at 10% strain/minute. Five specimens were tested for each sample, and the average and standard deviation were reported. A coefficient of variation of 5% for the modulus, 12% for the tensile strength, and 15% for the elongation to break was observed, which numbers include both the variation in the material and the measurement. The experiment demonstrated a low loading of Cloisite® (Sample 2) yielded good improvement in mechanical properties over gelatin alone (Sample 1). FIG. 4 illustrates the stress-strain curves of Samples 1 and 2. As shown in FIG. 4, the Young's modulus (the slope of the curve) increases by about 75%, and the tensile strength (the maximum stress during the test) by about 25% at a loading of 5% Cloisite® as compared to gelatin alone.

Figure 5:
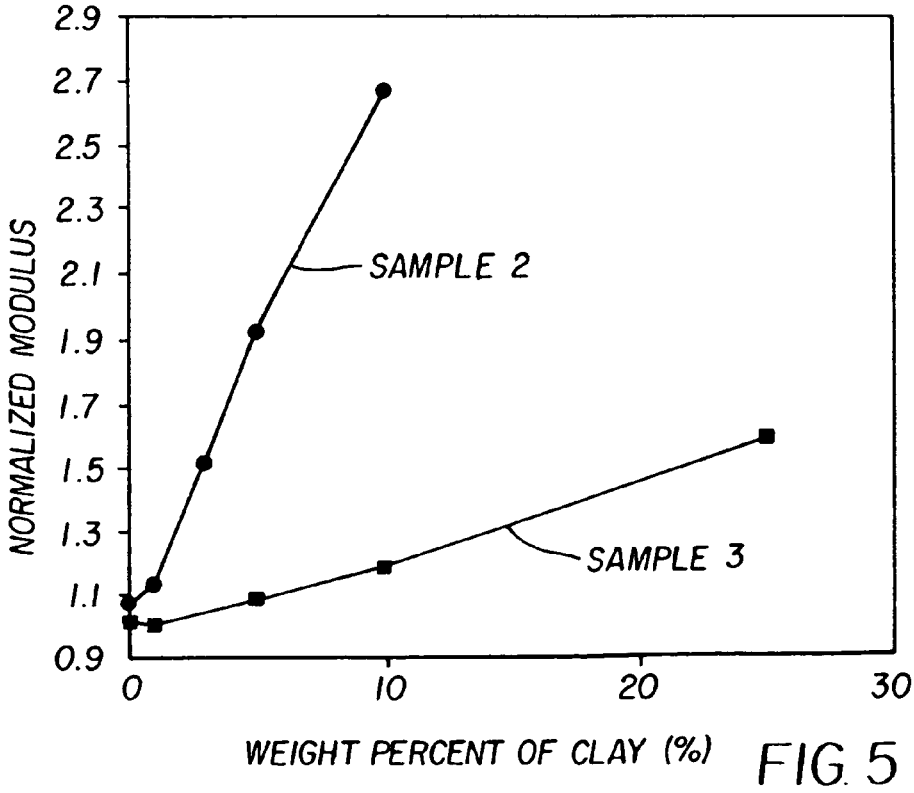
FIG. 5 depicts change in Young's modulus versus weight percent of various inorganic particles in gelatin.

The change in Young's modulus with varying loading of clay (0–25%) for Samples 2 and 3 was studied. The normalized modulus, the value of the Young's modulus of Sample 2 or Sample 3 normalized by the Young's modulus of Sample 1, gelatin, was determined for each sample. FIG. 5 demonstrates the increase in the normalized Young's modulus as the clay content increases. FIG. 5 also demonstrates the effect of the aspect ratio of the inorganic particles on the properties of the compositions. Laponite® has an aspect ratio that is an order of magnitude lower than that of Cloisite® (see Table 1). Laponite® causes less change in Young's modulus as compared to gelatin alone than Cloisite, as shown in FIG. 5. Thus, use of a particle having a higher aspect ratio is expected to more greatly increase the Young's modulus of a material than use of a particle with a lower aspect ratio.

Figure 6:
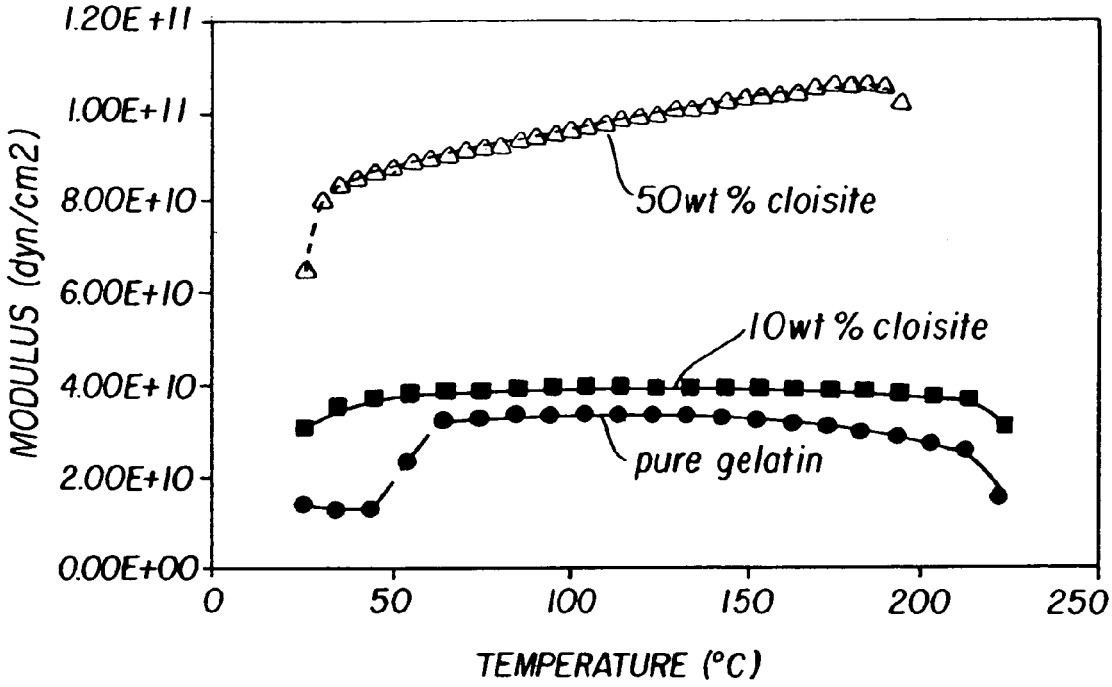
FIG. 6 depicts change in Young's modulus versus temperature of various inorganic particles in gelatin.

FIG. 6 compares the Young's modulus of Sample 2 at 10% and 50% loading of Cloisite with gelatin (Sample 1) at elevated temperatures. FIG. 6 shows that Sample 2 maintains a higher Young's modulus than gelatin at high temperatures. As shown in FIG. 6, the samples containing inorganic particles show at least a 10% increase in Young's modulus as compared to the control (gelatin) over a temperature range of from about 20° C. to about 200° C. The data was obtained by a dynamic mechanical thermal analysis (DMTA) done on a Rheometric DMA thermal analyzer. A 5 mm strip of each sample was cut and placed in a tension fixture with a fixed strain of 0.02%. The modulus (E') was measured at a frequency of 10 Hz while the temperature was increased from room temperature to 250° C.

The above example demonstrates the increased Young's modulus and tensile strength achieved by including inorganic particles in a polymer. The increase in Young's modulus is maintained even at elevated temperatures. Use of an inorganic particle with a higher aspect ratio further increases the Young's modulus of the polymeric material including the inorganic particles.

Example 2

Thermal Dimensional Stability

A nanocomposite material used in this example was a commercial smectite clay-polypropylene master batch C.31 PS, supplied by Nanocor. The master batch C.31 PS was a mixture of a smectite clay functionalized with swelling and compatibilizing agents, and polypropylene. The master batch was diluted with additional amounts of polypropylene or poly(ethylene terephthalate) in a co-rotating twin-screw compounder to form various nanocomposite materials, which were formed into films. some with additional work, as follows:

Sample 4—polypropylene, extruded;

Sample 5—polypropylene with 10% C.31 PS by weight, extruded;

Sample 6—polypropylene, extruded and biaxiallly stretched four times;

Sample 7—polypropylene with 10% C.31 PS by weight, extruded and biaxiallly stretched four times;

Sample 8—poly(ethylene terephthalate), extruded and biaxiallly stretched three times; and Sample 9—poly(ethylene terephthalate) with 4% C.31 PS by weight, extruded and biaxiallly stretched three times.

The Sample films 4–9, prepared and treated as indicated above, were cut into strips of 161 mm by 25.4 mm and marked about every 13 mm to aid in determination of any dimensional changes caused by heating. An oven was preheated to 150° C. The cut samples were placed in the oven for two minutes. The samples without inorganic particles shrunk, curled, and/or at least partially turned opaque. The samples with inorganic particles retained their original dimensions and color. As described herein, addition of the inorganic particles can reduce the occurrence of longitudinal shrinkage and/or transverse shrinkage of the polymeric material during heating by at least about 10% as compared to a control sample. For example, shrinkage in either direction can be reduced by an amount of at least about 25%, at least about 30%, at least about 50%, at least about 60%, at least about 75%, or more, up to 100%.

A dimension change test under web tension and increase in temperature was performed using Samples 1–9 cut into strips 6.35 mm wide by 49 mm gauge length. The samples were clamped at one end and stretched at the other end by a weight that produces a 0.00689 GPa tension load. The load magnitude is consistent with the common web tension load on a thermal printing ribbon during printing by methods and with devices known in the art. An oven was heated to various temperatures, up to and including 121° C. The tension-loaded samples were placed in the oven at specific temperatures for a period of one minute, and the elongations of the samples were measured after one minute in the oven at the specified temperature. Strains were calculated based on the gauge length and elongation. The results from Samples 4 and 5 are shown in FIG. 7.

Figure 7:
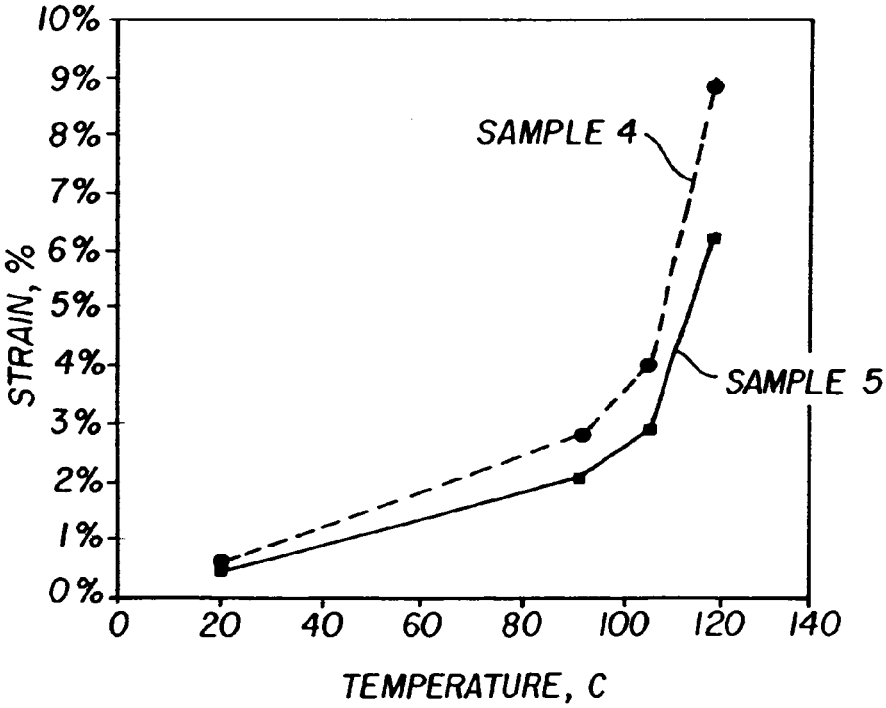
FIG. 7 depicts strain versus temperature for polypropylene with and without inorganic particles.

As shown in FIG. 7, the addition of inorganic particles can significantly reduce the deformation (elongation or strain) of the donor ribbon, even at a high temperature. For example, at 121° C., the strain of the polypropylene film of Sample 4 was 9%, while the strain of the polypropylene film with 10% inorganic particles of Sample 5 was 6%. This is a 30% reduction in strain. Similar results were seen with Samples 6 and 7, and with Samples 8 and 9. This example demonstrates that the addition of inorganic particles to a polymeric material can reduce strain or elongation of the polymeric material under increased temperatures by an amount of at least 10%, for example, at least 20%, at least 30%, or more.

The thermal dimensional stability of the samples was tested in a manner designed to mimic the heating condition of the thermal printing ribbon during printing. A metal block was placed in an oven for a period of time sufficient for the block to reach 160° C. The heated metal block was placed on top of a sample, exerting a pressure of 0.0008 GPa, and moved 60 mm along the surface of the sample over 2 seconds. Samples without inorganic particles developed significant wrinkles during the test, while samples with inorganic particles remained flat. Sample 9 was heated to 200° C. from room temperature after the above test was performed, and remained flat and translucent.

As shown by these examples, the addition of inorganic particles can increase the thermal dimensional stability of a polymeric material so that the ribbon maintains its shape and dimension without significant distortion when subjected to increased temperatures during printing. Without wishing to be bound by theory, it is believed that the thermal properties of the inorganic particles can be at least partially imparted to the polymeric material to which they are added. The addition of the inorganic particles to the polymeric material can significantly reduce the longitudinal elongation (strain), the longitudinal shrinkage, the transverse shrinkage, and/or the Young's modulus of the polymeric material. The affected properties of the polymeric material can prevent distortion of the polymeric material due to temperature increase during printing, thereby reducing occurrence of wrinkle and crease during printing.

Example 3

Thermal Conductivity

Changes in thermal conductivity are determined by measuring the thermal diffusivity of materials. Thermal diffusivity is related to thermal conductivity, and defined as the thermal conductivity of a material divided by the product of its specific heat and density. It is an important property for heat transfer. The flash method as set forth in standard test ASTM E1461-92 was used for thermal diffusivity measurements of a wide range of materials.

The thermal diffusivity of Samples 4 and 5 as prepared in Example 2 was measured using Holometrix μFlash according to the flash method, as set forth in ASTM El1461-92. The samples were prepared as circular disks with a diameter of 3 mm and a thickness of 0.795 mm. The diffusivity for Sample 4 was $6.16\times10^{-8}$ $m^2/s$, while the diffusivity for Sample 5 was $8.216\times10^{-8}$ $m^2/s$. The addition of 10% inorganic particles by weight increased the thermal diffusivity of the material by about 33%.

Example 4

Young's Modulus Effect on Wrinkle Formation

Wrinkles are the results of sharp changes in temperature and/or stresses that result in a local compressive stress that causes buckling of the thermal printing ribbon locally in certain direction. As discussed elsewhere herein, the critical buckling load (Pc) is proportional to the bending rigidity (D) of a sample having a given length and width. The bending rigidity is a linear function of the Young's modulus and a quadratic function of the thickness of the sample.

Samples were prepared and normalized wrinkle resistance determined as follows. The samples were prepared using gelatin and Cloisite® $Na^+$ supplied by Southern Clay Products, Inc (Gonzales, Tex., USA) in an amount and with a thickness as shown in Table 2. The Young's modulus of each sample, as shown in Table 2, was measured by tensile strength tests using ASTM D 882-80a in a standard environment of 50% RH and 23° C. For the comparative example having no inorganic particles, the maximum compressive stress the sample could sustain without buckling was determined and denoted as $\sigma_{critical}$. This number was used as a normalizing factor for the other samples in Table 2. For each sample, the normalized wrinkle resistance, R, in Table 2 is defined as the maximum compressive stress the sample can sustain without buckling divided by $\sigma_{critical}$.

Samples a–c demonstrated values of normalized wrinkle resistance, R, larger than 1, showing an improvement over the comparative sample without inorganic particles. Sample d was thinner than other samples, having a thickness of 5 μm. However, the Young's modulus of Sample d was still higher than the comparative example, as shown by the R value of 1.45, demonstrating a 45% improvement in wrinkle resistance over the comparative example.

TABLE 2

| Example | Thickness of Support μm | Cloisite clay weight % | Young's Modulus GPa | Normalized Wrinkle Resistance, R |
|---|---|---|---|---|
| Comp. Ex. | 6 | 0 | 3.2 | 1 |
| Ex. a | 6 | 2.5 | 4.8 | 1.5 |
| Ex. b | 6 | 5 | 5.6 | 1.75 |
| Ex. c | 6 | 10 | 8.0 | 2.5 |
| Ex. d | 5 | 19 | 8.0 | 1.45 |

As shown in the above examples, the addition of inorganic particles to a polymeric material can affect one or more property of the material, for example, the Young's modulus, the thermal conductivity, or the thermal dimensional stability. The thickness of a polymeric material formed with inorganic particles can be reduced as compared to a polymeric material without the inorganic particles while retaining one or more of the same properties. These properties can be manipulated to provide a polymeric material which, when incorporated into a thermal printing ribbon, provides a thermal printing ribbon having reduced or no wrinkling on printing.

The invention has been described in detail with particular reference to certain preferred embodiments thereof, but it will be understood that variations and modifications can be effected within the spirit and scope of the invention.

What is claimed is:

1. A method of thermal printing comprising:

forming a thermal printing ribbon comprising a dye donor layer, a support, and a polymeric layer, wherein the polymeric layer comprises a polymeric material and at least one inorganic particle, wherein the inorganic particle has a thermal conductivity greater than a thermal conductivity of the polymeric material;

forming a receiver comprising a dye-receiving layer and a support;

placing the dye donor layer of the thermal printing ribbon adjacent the dye-receiving layer of the receiver; and printing an image on the receiver, wherein the ribbon remains substantially free of wrinkle during printing.

2. The method of claim 1, wherein the inorganic particle has a Young's modulus greater than about 6 GPa.

3. The method of claim 1, wherein the polymeric layer is the support.

4. The method of claim 1, wherein the polymeric layer is between the support and the dye donor layer.

5. The method of claim 1, wherein the polymeric layer is on a side of the support opposite the dye donor layer.

6. The method of claim 1, wherein the inorganic particle is silica, a glass bead, a polymeric particle, alumina, mica, graphite, carbon black, a ceramic particle, or a combination thereof.

7. The method of claim 1, wherein the polymeric layer is a nanocomposite.

8. The method of claim 1, wherein the polymeric layer is extrusion coated.

9. The method of claim 1, wherein an occurrence of wrinkle is reduced by about 95% or more.

10. The method of claim 1, wherein the thermal printing is at a line speed of 4 ms or less.

11. The method of claim 1, wherein the ribbon has at least 10% less longitudinal elongation than a ribbon without inorganic particles.

12. The method of claim 1, wherein the ribbon has at least 10% less longitudinal shrinkage, transverse shrinkage, or both than a ribbon without inorganic particles.

13. The method of claim 1, wherein the inorganic particle has a thermal conductivity greater than 0.3 W/mK.

14. The method of claim 1, wherein the inorganic particle has a thermal conductivity greater than 50 W/mK.

15. The method of claim 1, wherein the polymeric material has a thermal conductivity of 0.3 W/mK or less.

16. A method of thermal printing comprising:

forming a thermal printing ribbon comprising a dye donor layer and a nanocomposite support, wherein the nanocomposite support comprises a polymeric material and at least one nano-sized inorganic particle;

forming a receiver comprising a dye-receiving layer and a support;

placing the dye donor layer of the thermal printing ribbon adjacent the dye-receiving layer of the receiver; and printing an image on the receiver, wherein the ribbon remains substantially free of wrinkle during printing.

17. The method of claim 16, wherein the inorganic particle has a thermal conductivity greater than a thermal conductivity of the polymeric material.

18. A method of reducing wrinkle during printing, comprising:

forming a thermal printing ribbon comprising a dye donor layer, a support, and a polymeric layer comprising a polymeric material and at least one inorganic particle, wherein the polymeric layer is a nanocomposite;

forming a receiver comprising a dye-receiving layer and a support;

placing the dye donor layer of the thermal printing ribbon adjacent the dye-receiving layer of the receiver; and printing an image on the receiver, wherein an occurrence of wrinkling is reduced by about 95% or more.

19. The method of claim 18, wherein the polymeric layer is the support.

20. The method of claim 18, wherein the inorganic particle is silica, a glass bead, a polymeric particle, alumina, mica, graphite, carbon black, a ceramic particle, or a combination thereof.

21. The method of claim 18, wherein the polymeric layer is extrusion coated.

22. The method of claim 18, wherein the inorganic particle has a Young's modulus of 6 GPa or greater.

23. The method of claim 18, wherein the polymeric layer is between the support and the dye donor layer.

24. The method of claim 18, wherein the polymeric layer is on a side of the support opposite the dye donor layer.

25. The method of claim 18, wherein the printing is at a line speed of 4 ms or less.

26. The method of claim 18, wherein the ribbon has at least 10% less longitudinal elongation than a ribbon without inorganic particles.

27. The method of claim 18, wherein the ribbon has at least 10% less longitudinal shrinkage, transverse shrinkage, or both than a ribbon without inorganic particles.

28. The method of claim 18, wherein the inorganic particle has a thermal conductivity greater than a thermal conductivity of the polymeric material.

29. The method of claim 18, wherein the inorganic particle has a thermal conductivity greater than 0.3 W/mK.

30. The method of claim 18, wherein the inorganic particle has a thermal conductivity greater than 50 W/mK.

31. The method of claim 18, wherein the polymeric material has a thermal conductivity of 0.3 W/mK or less.

* * * * *